US008425015B2

(12) United States Patent
Yamada et al.

(10) Patent No.: US 8,425,015 B2
(45) Date of Patent: Apr. 23, 2013

(54) LIQUID EJECTING APPARATUS

(75) Inventors: Yoichi Yamada, Shiojiri (JP); Kiyoteru Katsuki, Azumino (JP); Masaru Kobashi, Matsumoto (JP); Daisuke Matsumoto, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 160 days.

(21) Appl. No.: 12/914,662

(22) Filed: Oct. 28, 2010

(65) Prior Publication Data

US 2011/0102506 A1 May 5, 2011

(30) Foreign Application Priority Data

Oct. 29, 2009 (JP) ..... 2009-249177
Apr. 28, 2010 (JP) ..... 2010-103887

(51) Int. Cl.
*B41J 2/165* (2006.01)

(52) U.S. Cl.
USPC ..... 347/76

(58) Field of Classification Search ..... None
See application file for complete search history.

(56) References Cited

U.S. PATENT DOCUMENTS

2005/0206682 A1* 9/2005 Togashi et al. ..... 347/55
2006/0109325 A1* 5/2006 Araya et al. ..... 347/101
2007/0091146 A1 4/2007 Endo et al.

FOREIGN PATENT DOCUMENTS

JP 2003-165230 6/2003
JP 2007-118318 5/2007
JP 2007-118320 5/2007
JP 2007-118321 5/2007
JP 2008-213255 9/2008

* cited by examiner

*Primary Examiner* — Matthew Luu
*Assistant Examiner* — Alejandro Valencia
(74) *Attorney, Agent, or Firm* — Workman Nydegger

(57) ABSTRACT

Provided is a liquid ejecting apparatus including: an ejection target medium supporting section that is disposed to face the liquid ejecting section, and supports the ejection target medium and wherein in at least one of plural types of ejection target mediums having different thicknesses, a gap between the first surface of the ejection target medium supporting section and a rear surface facing the first surface in the ejection target medium is set to be smaller than a gap between a second surface facing the ejection target medium in the liquid ejecting section and a front surface facing the second surface in the ejection target medium.

3 Claims, 7 Drawing Sheets

LIQUID EJECTING APPARATUS

BACKGROUND

1. Technical Field

The present invention relates to a liquid ejecting apparatus which is represented by a fax machine or a printer.

2. Related Art

Hereinafter, an ink jet printer will be described as an example of a liquid ejecting apparatus. The ink jet printer includes an ink jet printing head and a support member (also called a platen) that is disposed at a position facing the ink jet printing head. A distance between the ink jet printing head and a printing sheet is defined by supporting the printing sheet using the support member.

Here, in ink jet printers in recent years, there has been a tendency for the size of an ink droplet to become smaller in order to further improve the printing quality. For example, the size of the ink droplet has become smaller to be about several pl. For this reason, the mass of the ink droplet is extremely small, and even when the ink droplet is ejected from the ink jet printing head onto the printing sheet, a part of the ink droplet does not land on the printing sheet, and floats in the form of mist, which causes various problems in ink jet printers. Further, in a so-called margin-less printing process in which the printing process is performed without any margin on four sides of the printing sheet, since the ink droplet is ejected even onto an area offset from the end of the printing sheet, the above-described mist floating phenomenon occurs more prominently.

Therefore, a technology has been proposed by JP-A-2007-118321 and JP-A-2007-118318, in which an ink jet printing head, a printing sheet, and a support member are set to have a difference in potential to generate an electric field, and a coulomb force is applied to an ink droplet to pull the ink droplet toward the printing sheet.

However, in recent years, ink jet printers have adopted a fixed ink jet printing head which is called a line head that is designed not to perform a scanning (moving) operation, but to perform a printing process with extremely high throughput. In this kind of ink jet printer, the printing sheet is transported at extremely high speed via a sheet transporting path inside the ink jet printer.

However, the following problems arose as the transportation speed of the printing sheet became faster. That is, paper dust generated when cutting a large original paper sheet adheres to the end (edge) of the printing sheet, but when a difference in potential is not adjusted in three components (hereinafter, generally referred to as "printing section constituting components") of the printing sheet, the support member (platen), and the ink jet printing head, the paper dust adhering to the printing sheet flies toward the ink jet printing head to thereby adhere thereto due to an electric field generated between the printing section constituting components. In particular, when the printing sheet is transported at high speed, vibration or impact generated during the transportation of the printing sheet becomes larger. For this reason, the paper dust flying phenomenon occurs more prominently.

Further, in accordance with friction between the printing sheets accommodated in a sheet cassette or slidable contacting between the printing sheet and the constituting component (for example, an edge guide, a transportation roller, or the like) of the sheet transporting path, friction charging or peeling charging becomes more prominent, that is, the printing section constituting components are more prominently charged. As a result, the electric field formed between the printing section constituting components becomes stronger, and charging of paper dust becomes stronger. For this reason, a coulomb force applied to the paper dust becomes larger, and the adhering of the paper dust to the ink jet printing head becomes more prominent.

Furthermore, even when the paper dust itself is not charged, if the flying paper dust is disposed within the electric field, biased charges occur in the paper dust due to dielectric polarization or electrostatic induction, thereby pulling the paper dust toward the ink jet printing head.

FIG. 7 is a diagram illustrating such problems, where the reference numeral 160 indicates an ink jet printing head, the reference numeral 160*a* indicates a nozzle plate, the reference numeral 170 indicates a support member (platen), and the reference numeral 170*a* indicates a rib formed on the support member 170. In addition, the reference numeral P indicates a printing sheet, the reference numeral Pe indicates a sheet end, and the reference numeral d indicates paper dust. Further, the circled "+" and "−" indicate charge polarities.

The printing sheet P is neutralized by a neutralization brush or the like, and hence the paper dust d adhering to the printing sheet P is not charged. However, as an example, when the nozzle plate 160*a* is charged to be positive, and the support member 170 is charged to be negative as shown in the enlarged view of the paper dust d, the paper dust d on the side of the nozzle plate takes negative charges, and the paper dust d on the side of the support member takes positive charges due to charge polarization (when the paper dust d has a property of a dielectric body) or electrostatic induction (when the paper dust d has a property of a conductor). Accordingly, the paper dust d is pulled toward any one of the nozzle plate 160*a* and the support member 170.

Then, when the paper dust adheres to the ink jet printing head, the paper dust directly blocks a nozzle opening, or the paper dust moves to the nozzle opening when a nozzle surface is cleaned (wiped), thereby causing dot omission.

In addition to the problem that the paper dust physically blocks the nozzle opening, a loading material such as calcium carbonate forming the paper dust causes a reaction with moisture to thereby be thickened and to thereby deteriorate vibration of a meniscus of the nozzle opening, which may disturb the ejection of the ink droplet. Accordingly, it is very important to prevent the paper dust from adhering to the ink jet printing head in order to obtain the appropriate printing quality in the ink jet printer.

As described above, JP-A-2007-118321 and JP-A-2007-118318 disclose a technology in which the ink jet printing head, the printing sheet, and the support member (the printing section constituting components) are set to have a difference in potential to generate the electric field, and the coulomb force is applied to the ink droplet to pull the ink droplet toward the printing sheet. Accordingly, assuming that the paper dust and the ink droplet are on the same line, it is thought that the paper dust may be prevented from adhering to the ink jet printing head in such a manner that the paper dust is pulled toward the printing sheet by controlling the electric field.

However, loading material and cellulose fiber forming the paper dust may be easily charged to any one of positive and negative polarities in the triboelectric series. Accordingly, even when there is an attempt to prevent the paper dust from flying toward the ink jet printing head by forming an electric field in a predetermined direction between the printing section constituting components, it is not possible to prevent the paper dust charged to the opposite polarity from flying toward the ink jet printing head.

Further, JP-A-2003-165230 discloses a printing apparatus in which an air duct is provided around a nozzle plate for the purpose of preventing paper dust or the like from adhering to the periphery of a nozzle portion of an ink jet printing head, and moist air is sprayed from the air duct in a printing mode and a printing standby mode. However, in this configuration, since the configuration is complex, there are concerns that the size and the cost of the printing apparatus increase, and that the paper dust unexpectedly adheres to the printing head due to the air stream.

Furthermore, JP-A-2008-213255 discloses a technology in which a paper dust collecting member having a charging property collects the paper dust. However, in the technology, the paper dust cannot be efficiently collected due to the problem involving the above-described opposite polarities, and another problem arises in that the paper dust accumulated on the paper dust collecting member needs to be treated (removed). In particular, when a large amount of paper dust is accumulated, the paper dust may scatter in the peripheral area thereof due to slight vibration or impact, thereby causing a problem that performance cannot be maintained over the long term.

SUMMARY

An advantage of some aspects of the invention is that it provides a liquid ejecting apparatus capable of reliably preventing foreign matter (hereinafter, referred to as "paper dust or the like") such as paper dust and dust from adhering to an ink jet printing head without degrading its printing quality.

A first aspect of the invention provides a liquid ejecting apparatus including: a liquid ejecting section that ejects a liquid onto an ejection target medium; and an ejection target medium supporting section that is disposed to face the liquid ejecting section, and supports the ejection target medium, wherein a first surface facing the ejection target medium in the ejection target medium supporting section is provided with a support portion that defines a distance between the liquid ejecting section and the ejection target medium while protruding from the first surface toward the liquid ejecting section and supporting the ejection target medium, and wherein in at least one of plural types of ejection target mediums having different thicknesses, a gap between the first surface of the ejection target medium supporting section and a rear surface facing the first surface in the ejection target medium is set to be smaller than a gap between a second surface facing the ejection target medium in the liquid ejecting section and a front surface facing the second surface in the ejection target medium.

According to the aspect, since a gap (hereinafter, referred to as a "support section side gap") between the first surface of the ejection target medium supporting section and the rear surface facing the first surface in the ejection target medium is set to be smaller than a gap (hereinafter, referred to as a "liquid ejecting section side gap") between the second surface of the liquid ejecting section and the front surface facing the second surface in the ejection target medium, a coulomb force generated by the electric field formed in the support section side gap and acting on the paper dust or the like adhering to the ejection target medium may be set to be larger than a coulomb force generated by the electric field formed in the liquid ejecting section side gap and acting on the paper dust or the like.

For this reason, the paper dust or the like adhering to the ejection target medium is strongly pulled toward the ejection target medium supporting section rather than the liquid ejecting section, thereby reliably preventing the paper dust or the like from flying and adhering to the liquid ejecting section.

A second aspect of the invention provides the liquid ejecting apparatus of the first aspect further including: a same potential forming section that sets the second surface of the liquid ejecting section and the first surface of the ejection target medium supporting section to have the same potential in an end area of the ejection target medium in a second direction intersecting a first direction as a transportation direction of the ejection target medium.

According to the aspect, since the second surface of the liquid ejecting section and the first surface of the ejection target medium supporting section have the same potential in the end area of the ejection target medium, any one of the support section side gap and the liquid ejecting section side gap reaches a state in which no electric field is formed (a non-electric-field state) in at least the end portion.

That is, although the paper dust or the like most prominently adheres to the end of the ejection target medium as described above, the end of the ejection target medium is disposed within the non-electric-field area, the paper dust or the like adhering to the end of the ejection target medium is suppressed from scattering and flying, and most of the paper dust or the like is discharged to the outside of the apparatus together with the ejection target medium while the paper dust or the like adheres thereto. Accordingly, it is possible to further reliably prevent the paper dust or the like from flying and adhering to the liquid ejecting section.

A third aspect of the invention provides the liquid ejecting apparatus of the first or second aspect, wherein the conductivity of the first surface of the ejection target medium supporting section is higher than the conductivity of the second surface of the liquid ejecting section.

According to the aspect, since the conductivity of the first surface of the ejection target medium supporting section is higher than the conductivity of the second surface of the liquid ejecting section, it is possible to reduce the induction (a phenomenon in which a conductor takes charges opposite to those of paper dust or the like and pulls the paper dust or the like when the paper dust or the like having a charge approaches the conductor) of the paper dust or the like toward the liquid ejecting section due to an image force. Accordingly, it is possible to further reliably prevent the paper dust or the like from flying and adhering to the liquid ejecting section.

A fourth aspect of the invention provides the liquid ejecting apparatus of anyone of the first to third aspects, wherein the second surface of the liquid ejecting section is formed by an insulating layer.

According to the aspect, since the second surface of the liquid ejecting section is formed by the insulating layer, it is possible to further reduce the induction of the paper dust or the like caused by the image force toward the liquid ejecting section. Accordingly, it is possible to further reliably prevent the paper dust or the like from flying and adhering to the liquid ejecting section.

A fifth aspect of the invention provides the liquid ejecting apparatus anyone of the second to fourth aspects further including: a conductive contact section that sets the second surface of the liquid ejecting section and the first surface of the ejection target medium supporting section to have the same potential, and comes into contact with the surface of the ejection target medium.

According to the aspect, since the second surface of the liquid ejecting section and the first surface of the ejection target medium supporting section are set to have the same potential by the conductive contact section, it is possible to set the ejection target medium to have the same potential as those of the first surface and the second surface in such a manner that the conductive contact section comes into contact with the ejection target medium. Here, since the conductive contact section comes into contact with the surface of the ejection target medium, it is possible to allow the liquid ejecting section side gap to have a difference in potential smaller than that of the support section side gap, that is, a non-electric-field state. Accordingly, it is possible to further reliably prevent the paper dust or the like from flying and adhering to the liquid ejecting section.

A sixth aspect of the invention provides the liquid ejecting apparatus of the fifth aspect, wherein the conductive contact section is formed by a roller that is in charge of transporting the ejection target medium while being provided on the upstream side of the liquid ejecting section in the transportation path of the ejection target medium.

According to the aspect, since the conductive contact section is formed by the roller that is in charge of transporting the ejection target medium, it is possible to simply form the conductive contact section using the existing constituent components at low cost.

A seventh aspect of the invention provides the liquid ejecting apparatus of anyone of the second to sixth aspects, wherein an area in the second direction of the first surface of the ejection target medium supporting section having the same potential as that of the second surface of the liquid ejecting section includes a position corresponding to at least one end of the ejection target medium in the second direction and extends more to the inside and outside of the ejection target medium than the position, and wherein a line connecting a terminal end position on the inside of the end of the ejection target medium in the first surface of the ejection target medium supporting section having the same potential as that of the second surface of the liquid ejecting section to a terminal end position on the outside of the end of the ejection target medium in the second surface of the liquid ejecting section is formed to intersect the ejection target medium in at least one end of the ejection target medium in the second direction.

According to the aspect, since the line connecting the terminal end position on the inside of the end of the ejection target medium in the first surface of the ejection target medium supporting section having the same potential as that of the second surface of the liquid ejecting section to the terminal end position on the outside of the position corresponding to the end of the ejection target medium in the second surface of the liquid ejecting section is formed to intersect the ejection target medium, even when an electric field is formed between the liquid ejecting section and an area located on the inside of the predetermined portion on the side of the ejection target medium supporting section, the end of the ejection target medium does not enter the electric field (the detailed description thereof will be conducted later).

With the above-described configuration, although the paper dust or the like most prominently adheres to the end area of the ejection target medium as described above, since the end area of the ejection target medium reliably enters a state in which the electric field formed between the liquid ejecting section and the ejection target medium supporting section set to have the same potential is extremely weak or the electric field is not substantially formed (hereinafter, referred to as a non-electric-field state for the convenience of description), it is possible to suppress the paper dust or the like adhering to the end of the ejection target medium from scattering and flying, and to discharge the paper dust or the like to the outside of the apparatus together with the ejection target medium while a large amount of the paper dust or the like adheres to the end of the ejection target medium. Accordingly, it is possible to reliably prevent the paper dust or the like from flying and adhering to the liquid ejecting section.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
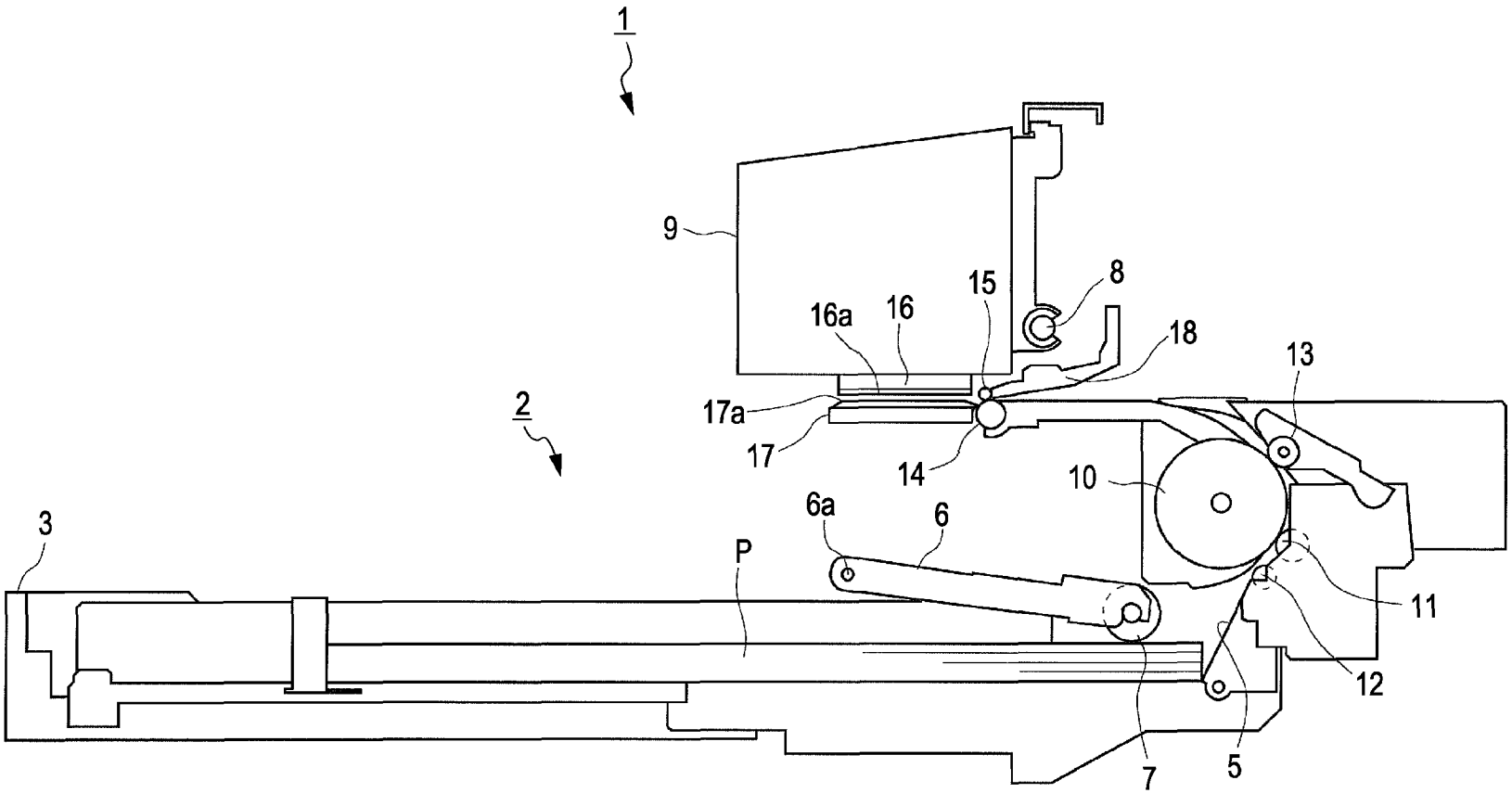
FIG. 1 is a schematic side cross-sectional view illustrating a sheet transporting path of a printer according to the invention.
Figure 2:
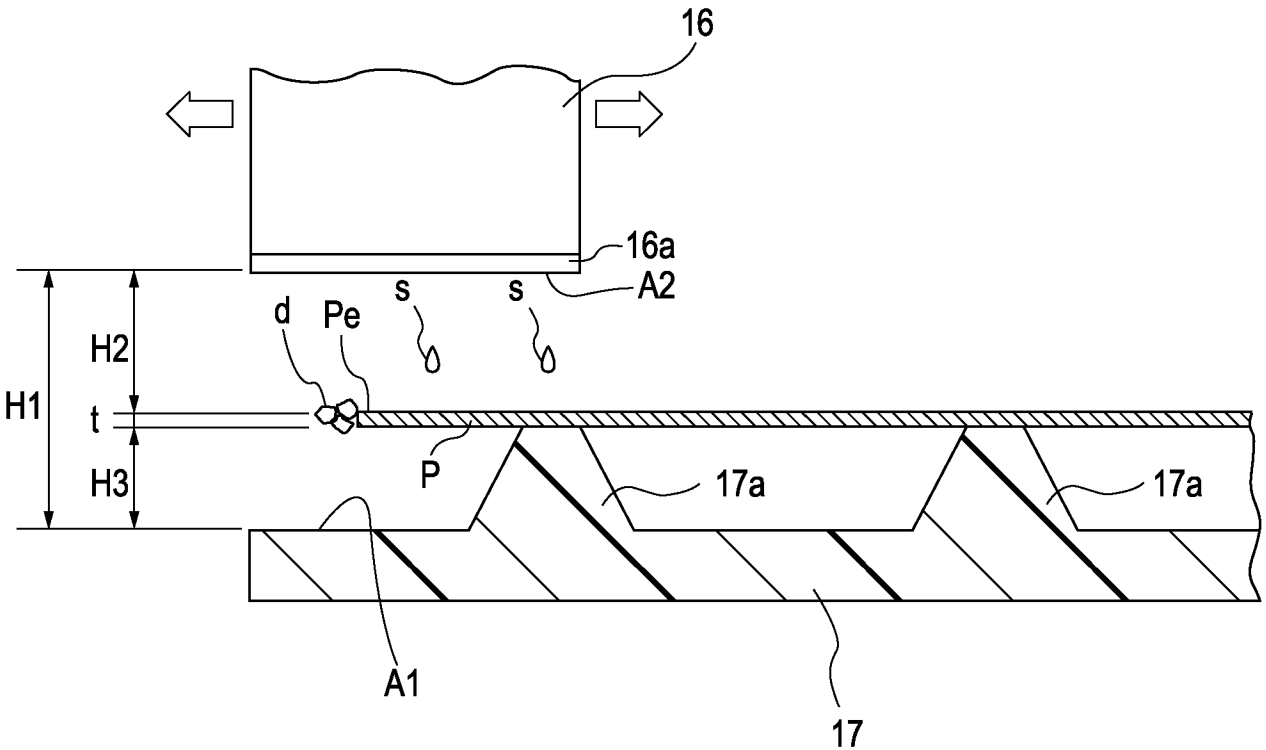
FIG. 2 is a conceptual diagram illustrating a basic concept of the invention.
Figure 3:
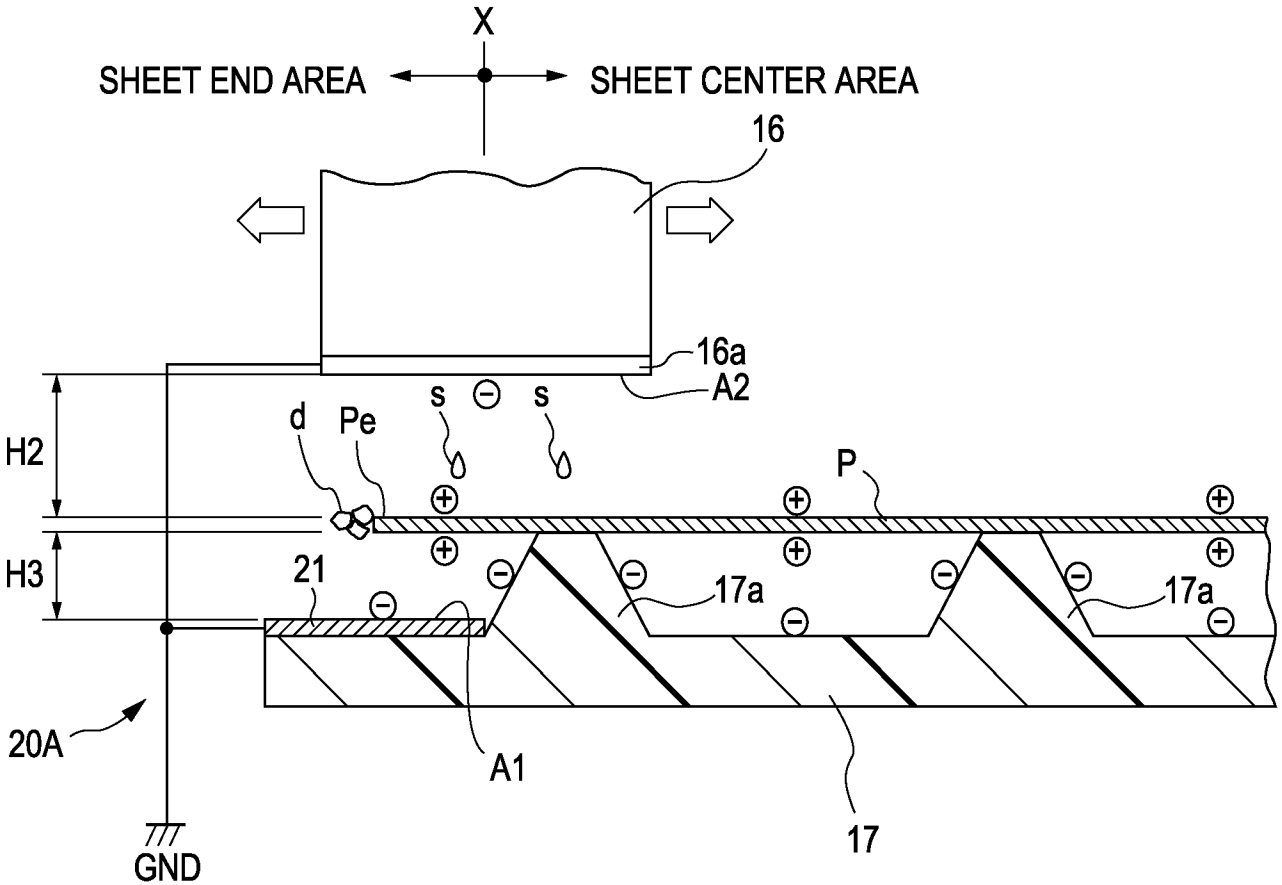
FIG. 3 is a diagram illustrating a charged state of a printing area of the printer according to a first embodiment of the invention.
Figure 4:
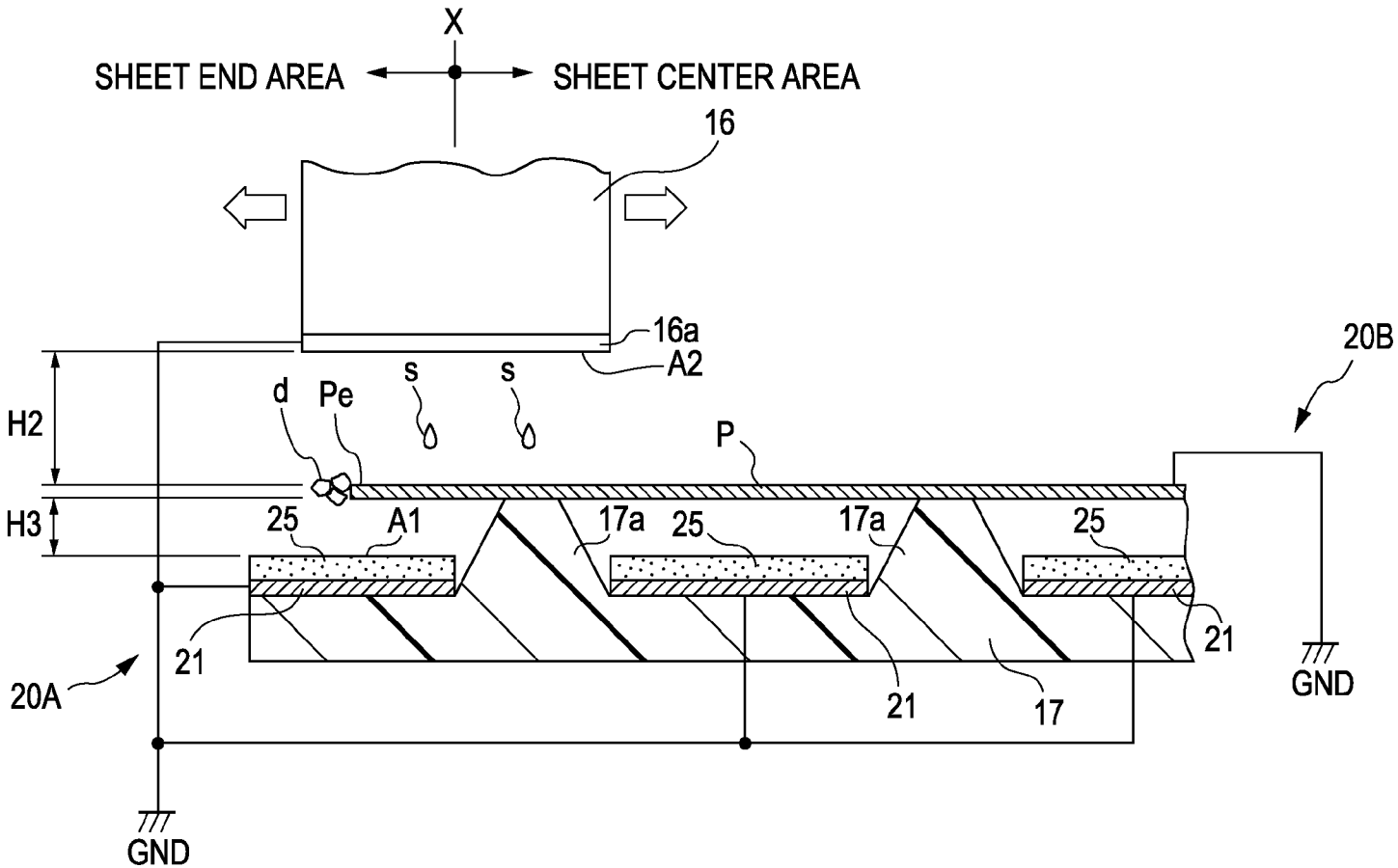
FIG. 4 is a diagram illustrating the charged state of the printing area of the printer according to the first embodiment of the invention.
Figure 5:
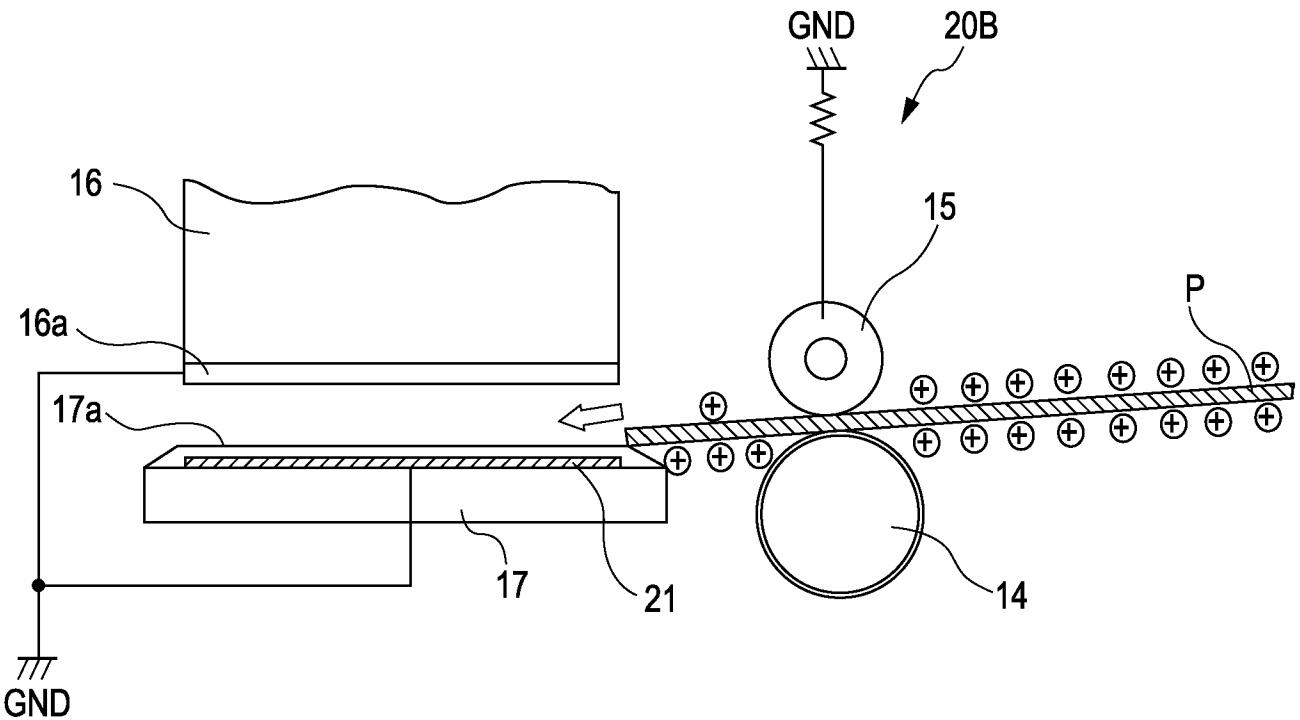
FIG. 5 is a diagram illustrating a configuration of a same potential forming section (a conductive contact section).
Figure 6:
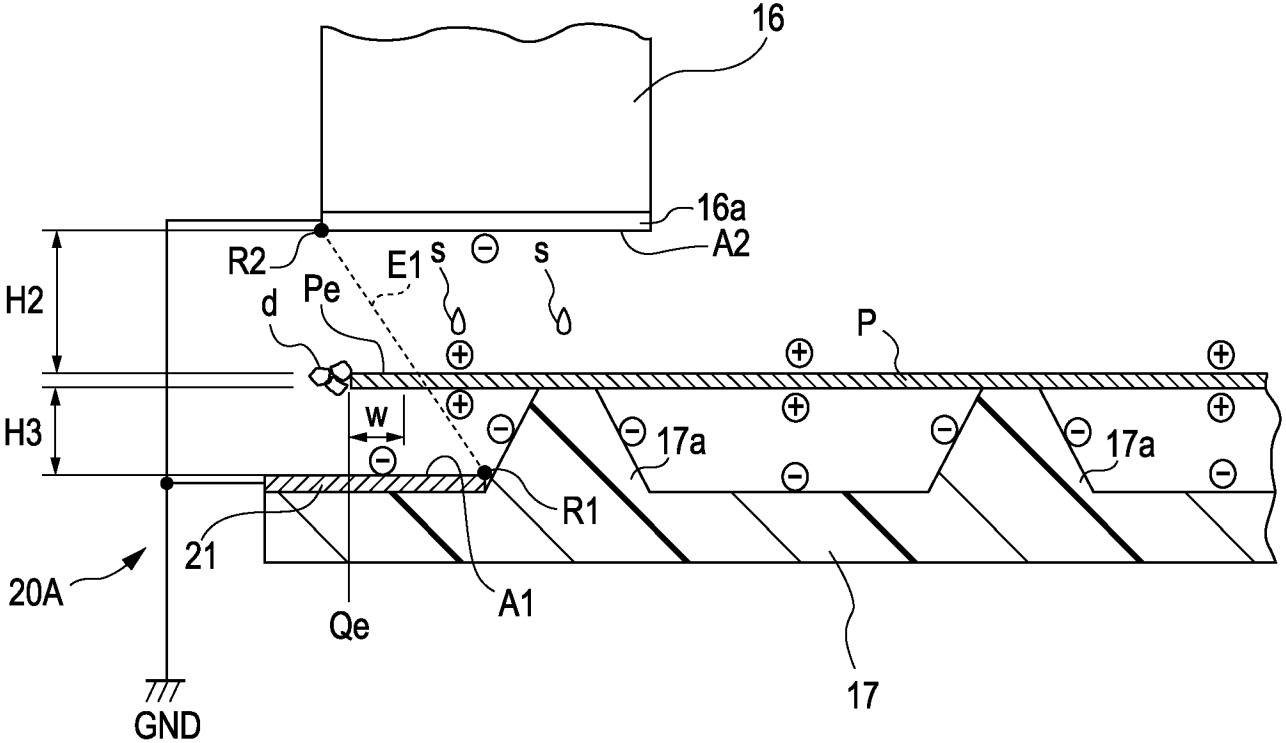
FIG. 6 is a diagram illustrating a charged state of the printing area of the printer according to a second embodiment of the invention.
Figure 7:
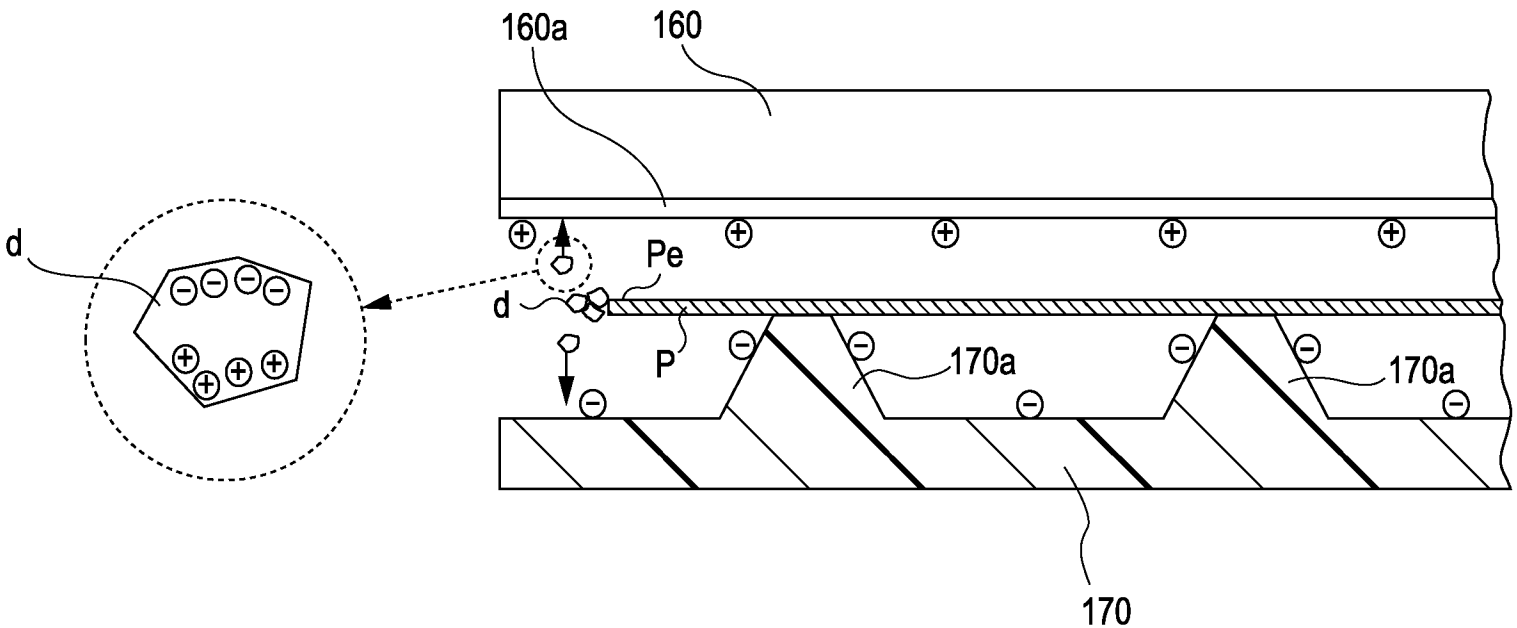
FIG. 7 is a diagram illustrating the problems of the related art.

Hereinafter, exemplary embodiments of the invention will be described with reference to the accompanying drawings. Here, FIG. 1 is a schematic side cross-sectional view illustrating a sheet transporting path of a printer 1 according to the invention. FIG. 2 is a conceptual diagram illustrating a basic concept of the invention. FIGS. 3 and 4 are diagrams illustrating a charged state of a printing area of the ink jet printer 1 according to the first and second embodiments. Further, FIG. 5 is a diagram illustrating a configuration of a same potential forming section (a conductive contact section) 20B. FIG. 6 is a diagram illustrating a charged state of the printing area according to the second embodiment. Further, FIGS. 2 to 4 and 6 illustrate an area on one side of an end of a sheet P, and an area on the other side thereof has the same configuration. In addition, a direction moving close to or away from the paper surface of FIGS. 1 and 5 is a second direction (a sheet width direction) perpendicular to a first direction as a sheet transporting direction. In FIGS. 2 to 4 and 6, the left/right direction of the drawing is the second direction (the sheet width direction), and the direction moving close to or away from the paper surface is the first direction (the sheet transporting direction).

Hereinafter, the overall configuration of the ink jet printer 1 as a common component of the respective embodiments will be described with reference to FIG. 1. The ink jet printer 1 includes a sheet feeding device 2 which is provided at the bottom portion of the printer. A printing sheet P as an example of an ejection target is fed from the sheet feeding device 2, and is turned over and reversed by a middle roller 10. Subsequently, the printing sheet P is fed to an ink jet printing head 16 as a liquid ejecting section, and a printing process is performed thereon.

More specifically, the sheet feeding device 2 includes a sheet cassette 3, a pickup roller 7, the middle roller 10, a retard roller 11, and guide rollers 12 and 13. A division slope surface 5 is provided at a position facing the front end of the printing sheet P accommodated in the sheet cassette 3 that is attachable to or detachable from the sheet feeding device 2. When the front end of the printing sheet P fed by the pickup roller 7 is fed to the downstream side while coming into contact with the division slope surface 5, the uppermost printing sheet P to be fed is preliminarily divided from the subsequent printing sheet P to be transported while overlapping therewith.

The pickup roller 7 constituting the sheet feeding section is axially supported to a tilting member 6 which is tiltable in the clockwise direction and the counter-clockwise direction of FIG. 1 about a tilting axis 6*a*, and is adapted to be rotationally driven by the power of a driving motor (not shown). When the pickup roller 7 rotates while coming into contact with the uppermost printing sheet P accommodated in the sheet cassette 3 during the sheet feeding operation, the uppermost printing sheet P is fed from the sheet cassette 3.

Next, the printing sheet P fed from the sheet cassette 3 enters a turning over and reversing area. This turning over and reversing area is provided with the middle roller 10, the retard roller 11, and the guide rollers 12 and 13.

The middle roller 10 is a large diameter roller which forms the inside of the turning over and reversing path used for turning over and reversing the printing sheet P, and is rotationally driven by a driving motor (not shown). Then, when the middle roller 10 rotates in the counter-clockwise direction of FIG. 1, the printing sheet P is wound and transported to the downstream side.

The retard roller 11 is adapted to come into press contact with or separate from the middle roller 10 while a predetermined rotational friction resistance is applied thereto. When the printing sheet P is nipped between the middle roller 10 and the retard roller 11, the uppermost printing sheet P to be fed is divided from the subsequent printing sheet P to be transported while overlapping therewith.

Further, the sheet transporting path in the vicinity of the retard roller 11 is provided with a sheet returning lever (not shown), and the subsequent sheet P restricted from being transported by the retard roller 11 is returned to the sheet cassette 3 by the sheet returning lever.

The guide rollers 12 and 13 are freely rotatable rollers, and the guide roller 13 among them assists the sheet feeding operation of the middle roller 10 by nipping the sheet P between the middle roller 10 and the guide roller 13.

As described above, the configuration of the sheet feeding device 2 is described, and the ink jet printer including the sheet feeding device 2 further includes a transportation driving roller 14 and a transportation driven roller 15 which are provided on the downstream side of the middle roller 10. The transportation driving roller 14 is rotationally driven by a driving motor (not shown), and the transportation driven roller 15 is rotated in accordance with the transportation of the printing sheet P while nipping the printing sheet P between the transportation driving roller 14 and the transportation driven roller 15.

The downstream side area of the transportation driving roller 15 is a printing area where the printing process is performed on the printing sheet P, and in the printing area, the ink jet printing head 16 as a liquid ejecting section faces a support member 17 as an ejection target support section that defines a distance between the printing sheet P and the ink jet printing head 16 by supporting the printing sheet P.

The ink jet printing head 16 is mounted on the bottom portion of a carriage 9, and the carriage 9 is adapted to reciprocate in the sheet width direction (the second direction) by a motor (not shown) while being guided by a carriage guide shaft 8 extending in the sheet width direction (the second direction: the direction moving close to or away from the paper surface of FIG. 1). Then, the printing process is performed on the printing sheet P by alternately repeating the scanning operation using the ink jet printing head 16 (the ink ejecting from the ink jet printing head 16 while moving the carriage 9) and the sheet transporting operation using the transportation driving roller 14 and the transportation driven roller 15.

Further, the invention is not limited to such a serial type printer, but may be, of course, applied to a printer including a so-called line head formed to have a length covering the sheet width (a type in which no scanning is performed by a head).

Then, the printing sheet P subjected to the printing process (in the printing area) between the ink jet printing head 16 and the support member 17 is discharged to the outside of the printer by a discharge section (not shown) in FIG. 1.

As described above, the schematic configuration of the ink jet printer 1 is described, and hereinafter the basic concept of the invention will be described with reference to FIG. 2. In addition, the reference numeral 16*a* of FIG. 2 denotes a nozzle plate which is formed of metal such as SUS or conductive silicon, has a plurality of ink ejecting nozzles (not shown) formed thereon, and forms a second surface (denoted by the reference numeral A2) facing the support member 17 in the ink jet printing head 16.

Further, the reference numeral 17*a* denotes a rib as a "support portion" which extends in the sheet transporting direction (the first direction: the direction moving close to or away from the paper surface of FIG. 2) and is formed to protrude from the first surface (denoted by the reference numeral A1) facing the nozzle plate 16*a* toward the nozzle plate 16*a* in the support member 17. A plurality of the ribs 17*a* is formed in the sheet width direction (the second direction: the left/right direction of FIG. 2) with an appropriate interval therebetween, and the printing sheet P is supported by the ribs 17*a*.

Further, the reference numeral Pe denotes the sheet end (the end in the sheet width direction), and the reference numeral d denotes paper dust or the like adhering to the sheet end Pe. Furthermore, the reference numeral s denotes ink droplets ejected from the ink jet printing head 16 toward the printing sheet P.

Further, the reference numeral H1 denotes a gap between the nozzle plate 16*a* (the second surface A2) and the support member 17 (the first surface A1), the reference numeral H2 denotes a gap (hereinafter, referred to as a "nozzle plate side gap H2") between the surface (the front surface) facing the nozzle plate 16*a* of the printing sheet P and the second surface A2, and the reference numeral H3 denotes a gap (hereinafter, referred to as a "support member side gap H3") between the surface (the rear surface) facing the first surface A1 of the support member 17 of the printing sheet P and the first surface A1. In addition, the reference numeral t denotes the thickness of the printing sheet P.

In the invention, the gaps H2 and H3 are respectively set so that the support member side gap H3 is smaller than the nozzle plate side gap H2 in at least one or more of a plurality of types of printing sheets (having different thickness t) to be used.

Accordingly, the coulomb force acting on the paper dust d or the like and generated by the electric field formed in the support member side gap H3 may be set to be larger than the coulomb force acting on the paper dust d or the like and generated by the electric field formed in the nozzle plate side gap H2. For this reason, the dust d adhering to the printing sheet P (particularly, the end thereof) is more strongly pulled to the support member 17 than the nozzle plate 16*a*, thereby reliably preventing the paper dust d or the like from flying and adhering to the nozzle plate 16*a*.

Further, when the thickness t of the printing sheet P increases, the nozzle plate side gap H2 decreases by an amount corresponding to an increase in the thickness. Accordingly, it is desirable that the protrusion height of the rib 17*a* from the first surface A1 is set in accordance with the printing sheet having the largest thickness t among the plural types of printing sheets to be used. Accordingly, in all printing sheets having all thicknesses to be used, the support member side gap H3 can be made to be smaller than the nozzle plate side gap H2. Further, the maximum thickness of the printing sheet to be used can be set in advance on the basis of the shape (the curvature or the like of the curved path) of the sheet transporting path of the ink jet printer 1.

In addition, even when the support member side gap H3 is smaller than the nozzle plate side gap H2, if the electric field of the nozzle plate side gap H2, that is, a difference in the potential between the printing sheet P and the nozzle plate 16*a* is larger than that of the support member side gap H3, the coulomb force acting on the paper dust d or the like of the nozzle plate side gap H2 becomes large as a result. Accordingly, it is desirable that a difference in the potential of the nozzle plate side gap H2 is equal to or smaller than a difference in the potential of the support member side gap H3.

First Embodiment

Hereinafter, a charged state of the printing area according to the first embodiment will be described with reference to FIG. 3. In addition, the ink jet printer 1 according to the first embodiment and the second embodiment is of a serial type in which ink droplets are ejected while the ink jet printing head 16 moves in the sheet width direction.

In FIG. 3, the reference numeral 20A denotes the same potential forming section. The same potential forming section 20A allows the second surface A2 of the nozzle plate 16*a* and the first surface A1 of the support member 17 to have the same potential in the sheet end area (the left side of the position X of the same drawing) including the end Pe of the printing sheet P.

More specifically, an electrode plate (for example, an SUS plate having a width of about 20 mm) 21 is provided in the end area of the printing sheet P in the support member 17, and the electrode plate 21 and the nozzle plate 16*a* are connected to earth. Accordingly, a difference in the potential between the nozzle plate 16*a* and the support member 17 becomes zero, thereby forming a state without any electric field. Further, the electrode plate 21 is formed at a certain position capable of having a length to cover at least the ink jet printing head 16 in the first direction.

On the other hand, the printing sheet P is in a floating state (a state where the potential is not controlled), whereby the front and rear surfaces of the printing sheet P are charged to any one of positive and negative by friction charging (positive charging in the example of FIG. 3).

Accordingly, an electric field is formed in the support member side gap H3 and the nozzle plate side gap H2 due to a difference in the potential (electric force lines are not shown). However, since the support member side gap H3 is smaller than the nozzle plate side gap H2, the coulomb force acting on the paper dust d or the like by the electric field of the support member side gap H3 increases. Accordingly, since the paper dust d or the like is more strongly pulled toward the support member 17 than the nozzle plate 16*a*, it is possible to reliably prevent the paper dust d or the like from flying and adhering to the nozzle plate 16*a*. Further, the support member side gap H3 of FIG. 3 is a gap between the upper surface of the electrode plate 21 and the rear surface of the printing sheet P. In the embodiment, H2 is set to about 2.0 mm, and H3 is set to about 1.5 mm in a normal sheet (having a thickness t=0.1 to 0.2 mm).

Further, in the embodiment, the electrode plate 21 is disposed in the sheet end area so as to exhibit the above-described effect at the sheet end area where the dust d most easily adheres, but the electrode plate 21 may be disposed in the center area (the right side of the position X in the same drawing) except for the sheet end area. However, since the nozzle plate 16*a* (the second surface A2) and the support member 17 (the first surface A1) are made to have the same potential in at least the sheet end area where the dust d most easily adheres, it is possible to reliably prevent the dust d from flying and adhering to the nozzle plate 16*a*. In addition, the width of the sheet end area (the distance from the sheet edge to the position X) may be appropriately adjusted in accordance with the adhering state of the paper dust d or the like. For example, the width may be set to about 2 mm at which the paper dust most easily adheres, or may be set to be in the range (for example, about 2 to 5 mm) with a slight margin. That is, the width may be appropriately adjusted in accordance with the adhering degree of the paper dust d or the like. Then, the electrode plate 21 is disposed at a certain area capable of having a width to cover the sheet end area.

Furthermore, in the embodiment, the support member 17 is formed of a resin and has a property of a dielectric body. For this reason, the printing sheet P and the support member 17 are changed by the friction therebetween, whereby an electric field may be formed between the printing sheet P and the support member 17. Accordingly, even when the electrode plate 21 is not disposed at the center area except for the sheet end, it is possible to pull the paper dust d or the like toward the support member 17.

Second Embodiment

Hereinafter, a second embodiment of the invention will be described with reference to FIG. 4. Further, the same reference numerals will be given to the same components described above, and hereinafter the repetitive description thereof will be omitted.

The embodiment is different from the first embodiment described with reference to FIG. 3 in that the electrode plate 21 is provided in the center area except for the sheet end area, a conductive ink absorbing member 25 is disposed in each electrode plate 21, and the potential of the printing sheet P is set to be the same as the potential of the second surface A2 of the nozzle plate 16*a* and the potential of the first surface A1 of the support member 17.

Even when the ink droplets are ejected to an area (for example, during a printing process without any margin) deviating from the printing sheet P, the ink absorbing member 25 is capable of reliably catching the ink droplets, thereby solving the problem caused by floating mist. Further, the support member side gap H3 of FIG. 4 is a gap between the front surface of the ink absorbing member 25 and the rear surface of the printing sheet P. In the embodiment, H2 is set to about 1.5 mm, and H3 is set to about 1.0 mm in a normal sheet (having a thickness t=0.1 to 0.2 mm).

Here, in the embodiment, the ink absorbing member 25 is formed to have a property of a conductor. Since the ink absorbing member 25 has conductivity, it is possible to reliably control the potential of the outermost surface of the ink absorbing member 25 (the outermost surface on the side of the nozzle plate).

Further, the ink absorbing member is formed to have conductivity in which the surface resistance is 102 to 108Ω/□

(for example, about 105Ω/□). Specifically, a structure may be used which is obtained by foaming a mixture of a resin such as polyethylene and polyurethane and a conductive material such as metal and carbon. Alternatively, a structure may be used which is obtained by attaching a conductive material such as metal and carbon to a resin foaming agent such as polyethylene and polyurethane. Alternatively, a structure may be used which is obtained by plating. Alternatively, a structure may be used which is obtained by impregnating electrolyte solution into a resin foaming agent such as polyethylene and polyurethane.

In the embodiment, the second surface A2 of the nozzle plate 16*a* and the first surface A1 on the side of the support member 17 are made to have the same potential (the earth potential) by the same potential forming section (the conductive contact section) 20B. Accordingly, basically an electric field is not formed therebetween, but even when the printing sheet P is slightly charged by friction charging or the like, since the support member side gap H3 is smaller than the nozzle plate side gap H2, it is possible to reliably prevent the paper dust d or the like from flying and adhering to the nozzle plate 16*a*.

Further, when the property of the sheet has a middle resistance, the printing sheet P has a time constant, and is gradually neutralized or applied with potential. In this case, even when the same potential forming section 20B comes into contact with the printing sheet P on the upstream side of the printing area, since the printing sheet P is charged to a certain degree in the printing area, an electric field is formed in the support member side gap H3 and the nozzle plate side gap H2. However, since the same potential forming section 20B comes into contact with the front surface of the printing sheet P, the neutralization/potential control of the front surface is more effectively performed than the rear surface thereof, and the electric field of the support member side gap H3 becomes stronger than the electric field of the nozzle plate side gap H2, thereby pulling the paper dust d or the like toward not the nozzle plate, but the support member 17.

Furthermore, the same potential forming section 20B may be formed of a conductive material that comes into contact with the printing sheet P. For example, the same potential forming section may be formed as a conductive brush or the like, or may be formed as a roller that is disposed on the upstream side of the printing area and including the transportation driving roller 15.

Specifically, as shown in FIG. 5, the transportation driven roller 15 may be formed of a conductive material, and may constitute the same potential forming section 20B via the earth connection. In this case, the transportation driven roller 15 comes into contact with the front surface of the printing sheet P, which may create a state in which a difference in the potential of the nozzle plate side gap H2 is smaller than that of the support member side gap H3, that is, a state without any electric field.

Other Variations

Same Potential Forming Section

In the above-described embodiments, the nozzle plate 16*a* and the electrode plate 21 are made to have the same potential via earth connection. However, the invention is not limited to the earth potential, but an arbitrary voltage having arbitrary polarity may be applied thereto. That is, only the nozzle plate 16*a* and the electrode plate 21 may have the same potential.

Further, the same potential forming section (the conductive contact section) 20B coming into contact with the printing sheet P may be formed to come into contact with the printing sheet P throughout the entire width of the printing sheet P, or may be formed to come into contact with only the sheet end area.

Furthermore, even when the second surface A2 of the nozzle plate 16*a* and the first surface A1 on the side of the support member 17 are not set to have the same potential, if the support member side gap H3 is set to be smaller than the nozzle plate side gap H2, it is possible to suppress the paper dust or the like from flying toward the nozzle plate compared with the case where the support member side gap H3 is set to be larger than the nozzle plate side gap H2.

Nozzle Plate

In the above-described embodiments, the surface of the nozzle plate 16*a* may be provided with a water repellent film. Here, when a conductive water repellent film is used, since it is possible to suppress the water repellent film from being charged, it is possible to suppress the paper dust or the like from adhering to the nozzle plate 16*a*, and to reliably control the potential of the nozzle plate.

Further, when an insulating water repellent film is used, it is possible to reduce an image force of the nozzle plate 16*a* formed of metal such as SUS, and to prevent the paper dust or the like floating in the vicinity of the nozzle plate from being pulled toward the nozzle plate 16*a*.

Furthermore, it is desirable that the potential application (control) position is located on the side of the support member 17 in the ink jet printing head 16, that is, the nozzle plate 16*a*. More specifically, it is desirable that the potential application position is located at the nozzle surface as a surface facing the support member 17. Accordingly, since the potential of the nozzle surface closest to the printing sheet P is controlled, it is possible to suppress the electric field rotating therearound, and to effectively prevent the paper dust or the like from adhering to the nozzle surface. Further, the same applies to the support member 17, and it is desirable that a predetermined portion subjected to the potential control is a surface facing the nozzle plate 16*a*.

Electrode Plate

In the first embodiment, the electrode plate 21 provided in the support member 17 may be replaced by the conductive ink absorbing member 25 shown in the second embodiment. Further, the electrode plate 21 may be formed to come into contact with the printing sheet P, but may be disposed as desired while ensuring a predetermined gap between the printing sheet P and the electrode plate 21 so as not to come into contact with the printing sheet P. Accordingly, it is possible to suppress the paper dust from accumulating on the electrode plate 21. Also, particularly in the case of the charged paper dust or the like, it is possible to suppress physical adhering and adhering caused by an image force.

Further, the support member 17 itself may be formed of a conductive material. Accordingly, since the electrode plate 21 is not required, it is possible to simplify the apparatus, and to decrease a cost thereof. As the material of the support member 17, for example, a material may be used which is obtained by mixing a conductive material such as metal and carbon with a resin. Further, the support member 17 may be formed of an insulating material, and a conductive material such as metal and carbon may be attached to the surface thereof.

Furthermore, in the above-described embodiments, it is desirable that the conductivity of the first surface A1 on the side of the support member 17 is set to be larger than the conductivity of the second surface A2 of the nozzle plate 16*a*. For example, when the conductivity of the material of the electrode plate 21 of the first embodiment is set to be larger than the conductivity of the nozzle plate 16*a*, it is possible to suppress the paper dust or the like from being pulled toward the nozzle plate 16*a* due to an image force. Accordingly, it is possible to further reliably prevent the paper dust or the like from flying and adhering to the nozzle plate 16*a*.

Charge Application to Ink Droplet

In the above-described embodiments, the ink droplets S are charged by induced charges via the nozzle plate 16*a*. However, charges may be applied to the ink droplets at an arbitrary position in an ink channel from an ink accommodating chamber (for example, an ink cartridge or the like) accommodating ink to the nozzle plate 16*a*. For example, when a part or entire part of the inner wall of the ink accommodating chamber is formed of a conductive member, charges may be applied to ink via the inner wall. Since the charges are applied to the ink droplets in this way, particularly in the sheet center area except for the sheet end, it is possible to reliably allow the ink droplets to land on the printing sheet P by using an electric field generated between the support member 17 and the nozzle plate 16*a* or between the printing sheet P and the nozzle plate 16*a*, and to prevent occurrence of the ink mist.

Further, since the same potential as that of the support member 17 is applied to the ink as the liquid, it is possible to weaken the electric field between the ink jet printing head 16 and the support member 17 to a large extent (or additionally the electric field between the printing sheet and the support member) at the sheet end area, and to form a countermeasure that prevents the paper dust from adhering to the nozzle plate 16*a*. That is, for example, the nozzle plate 16*a* is not limited to a conductor such as metal, but may be formed of a dielectric body such as silicon, acryl, and polyimide. In this case, when the potential of the ink inside the head is not controlled, an electric field generated by a difference in the potential between the ink inside the head and the support member 17 may have a strong influence on the paper dust, so that the paper dust flies toward nozzle plate 16*a*. However, since the same potential as that of the support member 17 is applied to the ink inside the head, such problems may be solved.

Furthermore, when the nozzle plate 16*a* is formed of a dielectric body, in order to apply a potential to the ink inside the head, only the ink channel portion (the portion contacting the ink) in the nozzle plate may be formed by a conductive member, and the potential may be applied to the ink via the conductive member. For example, when the nozzle plate has a lamination structure, the ink channel portion in all layers may be formed by the conductive member, and in at least one layer of them, the ink channel portion may be formed by the conductive member.

Configuration obtained in consideration of electric field formed by area other than electrode plate disposing area in support member In the above-described embodiments, since the configuration is designed by considering the electric field formed by the area except for the electrode plate disposing area in the support member 17, it is possible to further reliably prevent the paper dust or the like from scattering and flying. Hereinafter, this configuration will be described with reference to FIG. 6. Further, FIG. 6 is a modified example of the first embodiment shown in FIG. 3.

Here, in FIG. 6, the point R1 indicates the terminal end position of the electrode plate 21 that is located on the inside (the right side of FIG. 6) of the position Qe (the position of the support member 17 when a line is drawn from the sheet end toward the support member 17) corresponding to the sheet end in the electrode plate 21, and the point R2 indicates the terminal end position of the nozzle plate 16*a* that is located on the outside (the left side of FIG. 6) of the position Qe corresponding to the sheet end in the nozzle plate 16*a*. Further, the line depicted by the reference numeral E1 indicates the line connecting the points R1 and R2 to each other.

For example, in FIG. 6, since the area on the inside (the right side of FIG. 6) of the electrode plate 21 in the support member 17 is an area formed of a resin, there is a concern that an electric field is formed between the support member 17 and the nozzle plate 16*a* in an area on the inside (the right side of FIG. 6) of the line E1. That is, even when the sheet end area having the paper dust d or the like adhering thereto is interposed between the electrode plate 21 and the nozzle plate 16*a*, the above-described electric field is formed. For this reason, when the sheet end area enters the electric field, the paper dust d or the like adhering to the sheet end area may fly and scatter toward the nozzle plate 16*a*.

However, since the line E1 is made to be located on the inside (the right side of FIG. 6) of the sheet end area Pe, that is, the line E1 intersects the sheet, it is possible to reliably make the sheet end area to be in a state without any electric field. Accordingly, it is possible to reliably prevent the paper dust d or the like adhering to the sheet end area from scattering and flying toward the nozzle plate 16*a*. In addition, this configuration can be realized by adjusting the width or the arrangement of the electrode plate 21 or the stop position, etc. of the ink jet printing head 16 when transporting the printing sheet P using the transportation driving roller 14 and the transportation driven roller 15.

Further, in the embodiment, the line E1 is made to pass the inside of the sheet in an area having a distance w between the sheet end area and the sheet inside area, but when the line E1 is made to pass at least the inside of the sheet end (edge), it is possible to obtain a predetermined effect of preventing the paper dust from scattering. Furthermore, the distance w may be set in consideration of the adhering degree of the paper dust d or the like to be, for example, about 2 mm at which the adhering of the paper dust d or the like most easily occurs. Alternatively, the distance w may be set to a range (for example, w=about 2 to 5 mm) with a slightly larger margin than 2 mm. That is, the distance w may be appropriately adjusted in accordance with the adhering degree of the paper dust d or the like.

Furthermore, in the above-described embodiments, the configuration of the invention is applied to both one end and the other end of the printing sheet P, but the invention is not limited thereto. Even when the configuration of the invention is applied to one end area of the printing sheet P, it is needless to say that the same effect can be obtained in the other end area of the printing sheet.

What is claimed is:

1. A liquid ejecting apparatus comprising:

a liquid ejecting section that ejects a liquid onto an ejection target medium; and an ejection target medium supporting section that is disposed to face the liquid ejecting section, and that supports the ejection target medium, wherein the ejection target medium supporting section includes a first surface arranged to face the ejection target medium, wherein the first surface is provided with a support portion that defines a distance between the liquid ejecting section and the ejection target medium while protruding from the first surface toward the liquid ejecting section and supporting the ejection target medium, and wherein in at least one of plural types of ejection target mediums having different thicknesses, a gap between the first surface of the ejection target medium supporting section and a rear surface of the ejection target medium facing the first surface is set to be smaller than a gap between a second surface of the liquid ejection section facing a front surface of the ejection target medium in the liquid ejecting section and a front surface facing the second surface in the ejection target medium, wherein the first surface and the second surface have the same potential and the ejection target medium is in a floating state such that a first electric field is present between the ejection target medium and the second surface and a second electric field is present between the ejection target medium and the first surface; and wherein a conductivity of the first surface of the ejection target medium supporting section is higher than a conductivity of the second surface of the liquid ejecting section.

2. The liquid ejecting apparatus according to claim 1, further comprising:

a same potential forming section that sets the second surface of the liquid ejecting section and the first surface of the ejection target medium supporting section to have the same potential in an end area of the ejection target medium in a second direction intersecting a first direction as a transportation direction of the ejection target medium.

3. A liquid ejecting apparatus comprising:

a liquid ejecting section that ejects a liquid onto an ejection target medium; and an ejection target medium supporting section that is disposed to face the liquid ejecting section, and that supports the ejection target medium, wherein the ejection target medium supporting section includes a first surface arranged to face the ejection target medium, wherein the first surface is provided with a support portion that defines a distance between the liquid ejecting section and the ejection target medium while protruding from the first surface toward the liquid ejecting section and supporting the ejection target medium, and wherein in at least one of plural types of ejection target mediums having different thicknesses, a gap between the first surface of the ejection target medium supporting section and a rear surface of the ejection target medium facing the first surface is set to be smaller than a gap between a second surface of the liquid ejection section facing a front surface of the ejection target medium in the liquid ejecting section and a front surface facing the second surface in the ejection target medium, wherein a conductivity of the first surface of the ejection target medium supporting section is higher than a conductivity of the second surface of the liquid ejecting section.

* * * * *